United States Patent [19]

Crockett, Sr.

[11] 4,001,531

[45] Jan. 4, 1977

[54] WATER ALARM SWITCH

[76] Inventor: James R. Crockett, Sr., 3327 Zuni Circle, Las Vegas, Nev. 89109

[22] Filed: May 22, 1975

[21] Appl. No.: 579,891

[52] U.S. Cl. ..... 200/61.04

[51] Int. Cl.[2] ..... H01H 29/00

[58] Field of Search ..... 200/61.04, 61.06, 61.07, 200/61.08; 340/235, 421; 337/401, 407, 408, 409, 416

[56] References Cited

UNITED STATES PATENTS

| | | | |
|---|---|---|---|
| 539,234 | 5/1895 | Neu | 200/61.04 |
| 664,331 | 12/1900 | Martin | 200/61.04 X |
| 1,095,382 | 5/1914 | Clorius et al. | 337/408 |
| 1,106,151 | 8/1914 | Matthews | 337/408 |
| 1,122,032 | 12/1914 | Scheuer | 337/409 |
| 1,159,602 | 11/1915 | Scheuer | 337/409 |
| 2,094,825 | 10/1937 | Sarcione | 337/409 |
| 3,169,724 | 2/1965 | Perkins | 337/416 |
| 3,311,721 | 3/1967 | Wright | 200/61.04 |
| 3,787,650 | 1/1974 | Lewis | 200/61.04 |

*Primary Examiner*—James R. Scott
*Attorney, Agent, or Firm*—Clarence A. O'Brien; Harvey B. Jacobson

[57] ABSTRACT

A water alarm switch having a water-soluble element arranged abutting a support frame on which an elongated member is slidably mounted. The elongated member is anchored on the water-soluble element and cooperates with a spring arranged abutting the frame for biasing the water-soluble element against the frame and retaining the elongated member in a switch-open position. The dissolving of the water-soluble element due to contact with water, and the like, releases the elongated member and permits same to move under the bias of the spring so as to bring electrically connected contacts affixed to the elongated member into contact with mating contacts affixed to the frame and close both the switch and external alarm circuit connected to the contacts affixed on the frame.

7 Claims, 9 Drawing Figures

Fig. 1
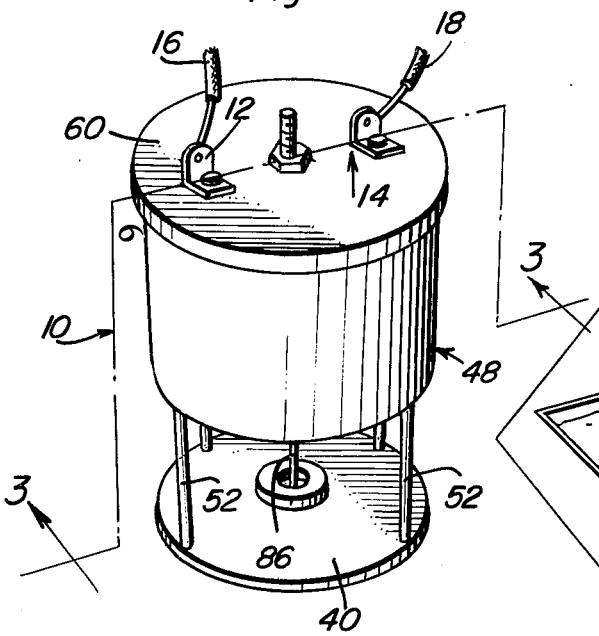
Fig. 8
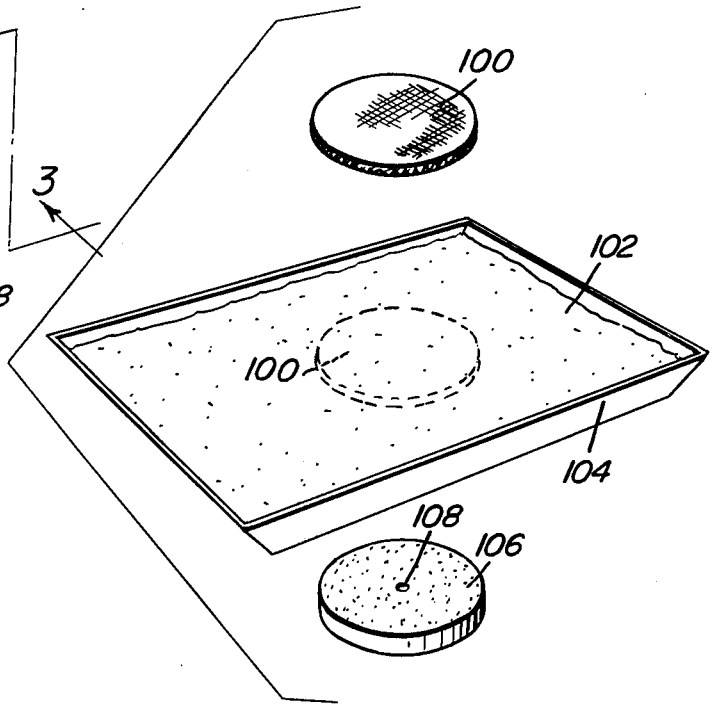
Fig. 9
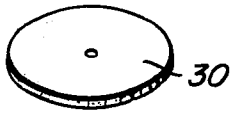
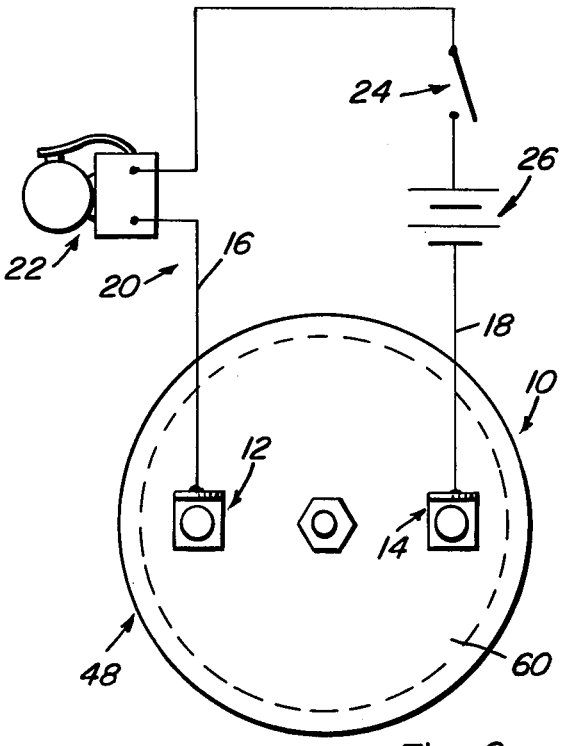
Fig. 2
Fig. 7
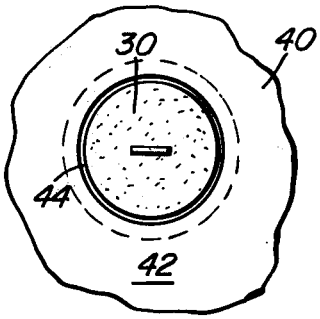

WATER ALARM SWITCH

BACKGROUND OF THE INVENTION

1. Field of the Invention

This invention relates generally to a condition-responsive switch, and particularly to a switch actuated by the presence of water, or similar liquid, so as to energize an associated alarm circuit, and the like.

2. Description of the Prior Art

There is a definite need for a water-sensitive switch which will detect the presence of a small amount of water on a floor, and the like, and which will actuate an alarm circuit in order to give warning of the water leakage and permit early action to be taken before serious water damage occurs. Such a switch would be particularly useful when placed in remote or seldom visited locations, such as closets, under counter storage spaces, utility rooms, and the like, in which water piping, valving, and storage tanks are located.

U.S. Pat. No. 539,234, issued May 14, 1895 to G. S. Neu, discloses a water alarm switch intended for use in conjunction with conventional automatic fire sprinkler systems in order to give warning of actuation of the associated sprinkler. Further, U.S. Pat. No. 3,787,650, issued Jan. 22, 1974 to W. J. Lewis, discloses a water detecting device which detects the presence of water in fuel lines, and the like. Both of these known water detecting arrangements rely on a water-soluble element which will dissolve in the presence of water, or similar liquid, and cause a spring biased electrical switch element to close in order to actuate an external alarm circuit. U.S. Pat. Nos. 896,874, issued Aug. 25, 1908 to H. Williams, 1,106,151, issued Aug. 4, 1914 to G. H. Matthews, and 1,116,458, issued Nov. 10, 1914 to M. Matos, disclose condition responsive switches of generally similar construction to those referred to above, but being heat responsive as opposed to water responsive. These known condition-responsive switches, however, are not specifically intended, or especially suited, for use when sensing the presence of a small amount, perhaps as little as 1/25th of an inch (approximately one millimeter) of water, and the like, on a floor or similar support surface.

SUMMARY OF THE INVENTION

It is an object of the present invention to provide a water alarm switch capable of detecting the presence of water, from any source, when as little as, for example, 1/25th of an inch of water is deposited on a floor, and the like.

It is another object of the present invention to provide a water alarm switch specifically intended to be placed on a planar support surface such as a floor so as to detect the presence of a small amount of water on the floor.

It is still another object of the present invention to provide a water alarm switch having a water sensitive element which is inexpensive to manufacture and quickly and easily inserted into the switch.

It is a still further object of the present invention to provide a water alarm switch which may be connected into any conventional alarm circuit.

These and other objects are achieved according to the present invention by providing a water alarm switch having: a support frame; a water soluble element arranged abutting the support frame; an elongated member anchored on the water-soluble element and arranged biasing the element against the frame; a member anchored on the water-soluble element and arranged biasing the element against the frame; two selectively cooperable electrical contacts, one of the contacts affixed to the frame and the other of the contacts affixed to the member, with the member being slidably mounted on the frame for movement toward and away from the one of the contacts; and a resilient element, such as a spring, arranged engaging the member and the frame for biasing the member toward the one of the contacts and bringing the other of the contacts into contact with the one of the contacts whenever the water-soluble element is loosened and releases the member.

As used herein, the term "water-soluble" is intended to include not only those materials which actually dissolve when subjected to water or other liquid, but also those materials which merely become limp, or non-rigid, when wetted.

The support frame advantageously is in the form of a base plate including a support surface having a recess opening onto the support surface, with the connecting member being arranged in the aperture. The contacts are arranged in a housing which is connected to the base plate, and supported thereby, by means of a framework connected to the housing and the base plate so that the housing is in a spaced relationship above the base plate.

The water-soluble element is preferably in the form of a disk and the member which causes the element to be biased against the recess provided in the base plate is advantageously an elongated member including a rigid push rod which extends entirely through the housing. A length of flexible filament having T-heads at each of its spaced ends attaches the disk to the push rod by means of an eye provided in the adjoining end of the push rod through which one of the T-heads is inserted. The other of the T-heads of the filament is inserted through the disc for retaining same.

Each of the contacts advantageously includes a pair of spaced points, with a pair of the points being electrically connected together and affixed to the push rod so as to electrically connect together a pair of electrically insulated points affixed to the housing whenever the water-soluble element releases the biasing member and permits the push rod to move away from the base plate under the bias of the spring. The latter is advantageously a compression spring arranged abutting a large portion of the push rod and a bottom wall of the housing in order to obtain the requisite bias on the push rod.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view showing a water responsive switch according to the present invention.

FIG. 2 is a schematic diagram showing the switch of FIG. 1 connected to an external alarm circuit.

FIG. 7 is a fragmentary, bottom plan view of the water responsive switch of FIG. 1—6.

FIG. 8 is a perspective view showing one perferred method for constructing water-soluble elements for use with the water responsive switch according to the present invention.

FIG. 9 is a perspective view showing another form of water-soluble element for use with the water responsive switch according to the present invention.

DESCRIPTION OF THE PREFERRED EMBODIMENT

Figure 3:
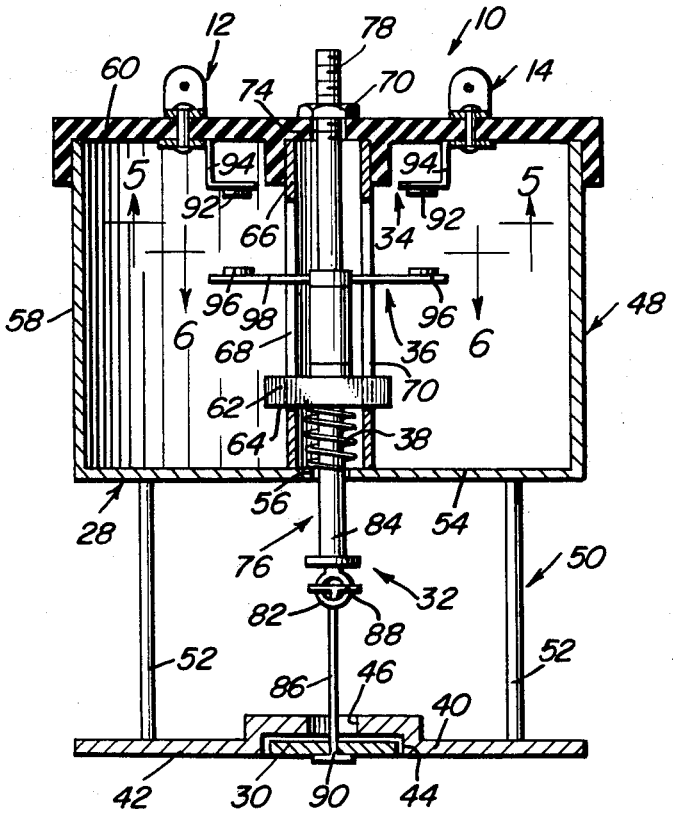
FIG. 3 is a sectional view taken generally along the line 3—3 of FIG. 1.

Referring now more particularly to FIGS. 1 and 2 of the drawings, a water responsive switch 10 according to the present invention is provided with a pair of lugs 12 and 14 to which wires 16 and 18 can be selectively connected in order to connect switch 10 into an external electrical alarm circuit 20, and the like. As is shown in FIG. 2, such a circuit 20 may include a conventional bell 22, an on-off switch 24 and a battery 26 or other suitable power source. It is to be understood, however, that the present invention is directed to switch 10 per se and the illustration of circuit 20 in FIG. 2 is not intended to limit the possible uses of switch 10.

Referring now more particularly to FIGS. 3–7 of the drawings, switch 10 includes a support frame 28 against which is abutting a water-soluble element 30 retained by a slidably mounted elongated member 32 which is anchored on the water-soluble element 30 in a manner to be described below for biasing element 30 against frame 28. Two electrical contacts 34 and 36 are provided. Contact 34 is affixed to frame 28, while contact 36 is affixed to member 32, with member 32 being arranged extending toward contact 34. Further, the sliding mounting of member 32, to be described in greater detail below, permits contact 36 to move toward and away from contact 34. A resilient device, such as the illustrated coiled compression spring 38, engages member 32 and frame 28 for biasing member 32 toward contact 34 and bringing contact 36 into electrical contact with contact 34 whenever element 30 is loosened and releases member 32.

Support frame 28 comprises a base plate 40 including a support surface 42 having a recess 44 opening onto support surface 42 and provided with an aperture 46. Water-soluble element 30 is disposed in recess 44, while the elongated member 32 is arranged in aperture 46 so as to extend from recess 44 toward a housing 48 supported on base plate 40 as by a framework 50 formed by a plurality of rods, or columns, 52 connected to housing 48 and base plate 40 and supporting housing 48 in spaced relation above base plate 40.

Contacts 34 and 36 are disposed within housing 48, with the latter being partially formed by a bottom wall 54 arranged facing base plate 40 and provided with an opening 56 aligned with aperture 46 provided in base plate 40. Elongated member 32 is arranged in opening 56 so as to extend into housing 48, with contact 36 being affixed to a portion of member 32 disposed within housing 48. The latter is further formed by a substantially cylindrical side wall 58 connected to and extending from bottom wall 54 in the direction away from base plate 40 and supporting a cover 60 forming a top wall of housing 48 spaced from bottom wall 54 so as to enclose the contacts 34, 36.

Member 32 has an enlarged portion 62, advantageously in the form of the illustrated bar-shaped element, forming an abutment surface 64 for one of the ends of spring 38. The wire is disposed within housing 48 and arranged between, and abutting, the abutment surface 64 of enlarged portion 62 and the bottom wall 54 of housing 48. By proper design, the elongated member 32 is arranged for deflecting spring 38 a predetermined amount when member 32 is anchored to element 30.

Housing 48 advantageously further includes a duct 66 arranged extending from cover 60 to bottom wall 54. Member 32 is disposed in duct 66, with a pair of opposed slots 68 and 70 being provided in the duct 66 and extending toward cover 60 and bottom wall 54 so as to provide clearance for contact 36 and enlarged portion 62 when member 32 is released by loosening of element 30 and permitted to slide upwardly through housing 48 under the bias of spring 38 A stop element advantageously in the form of a conventional nut 72 cooperates with the upper surface of cover 60 for limiting movement of member 32 toward bottom wall 54 of housing 48. As can be readily seen from FIGS. 3 and 4 of the drawings, a hole 74 is provided centrally in cover 60 for permitting member 32 to pass upwardly out of housing 48.

Elongated member 32 includes a rooted push rod 76 arranged extending through housing 48, and opening 56 and hole 74, and provided with screw thread 78 at the upper end 80 thereof for threadingly receiving nut 72. An eye 82 is provided at the lower end 84 of push rod 76 for a purpose which will become clear. A flexible filament 86 having T-heads 88 and 90 at each spaced end thereof is employed to attach element 30 to push rod 76. Such filaments, generally constructed from nylon and the like, are commonly employed to attach price tags to goods and for similar uses. As shown, filament 86 is connected to push rod 76 by insertion of T-head 88 through eye 82, while attachment to element 30 is achieved by insertion of T-head 90 through the disc which forms the element 30. It will be appreciated that the structural nature of filament 86 facilitates its attachment to element 30.

Contact 34 includes a pair of points 92 each individually affixed to the inner surface of cover 60 as by suitable S-shaped brackets 94, while contact 36 includes a pair of points 96 mounted on the spaced ends of a conductive contactor blade 98 affixed to push rod 76. As is clearly shown in FIG. 3, brackets 94 are electrically connected to lugs 12, 14 so that when points 96 are engaged with points 92 an electrical circuit is completed through blade 98, brackets 94 and lugs 12, 14, as is clearly shown in FIG. 4.

Referring now to FIG. 8 of the drawings, a procedure as shown therein for making a water-soluble element form a thin disk 100 constructed from coding paper, cloth material, and the like immersed in a solution 102 of a heavy paste made from, for example, vegetable starch, contained in a conventional pan 104 and then thoroughly dried to form a composite element 106. Such an element 106 is rigid enough to retain spring 38 in a ready position. When element 106 comes in contact with water, and the like, however, the vegetable starch, and the like, then dissolves, and the paper or cloth material becomes limp, which limpness or nonrigidity allows spring 38 to be released and the electrical circuit closed.

There are many common materials or substances which are suitable for disk 100. Even disks cut from common blotter paper have worked quite effectively.

FIG. 9 shows the water-soluble element 30 in the form of a disk which may be molded, and the like, from a water-soluble composition known per se. A satisfactory paste was prepared and subsequently tested by combining, by volume, three parts of common water putty powder, such as that marketed as "Spackle" with one part of wheat paste powder thoroughly mixed with six parts of water to form a heave paste dough. This dough is then rolled to an even thickness of approximately, for example, ⅛th of an inch and cut into circles, of perhaps ¾th of an inch in diameter, with a conventional cookie cutter, and the like. The cut dough disks are then preferably dried in a 400° oven for approximately 30 minutes. Once dried and removed from the oven, the disks have, for example, ⅛th of an inch holes 106 punched in their centers to facilitate attaching a filament 86. The disks may now be returned to the 400° oven and dried for an additional 15 minutes.

Figure 4:
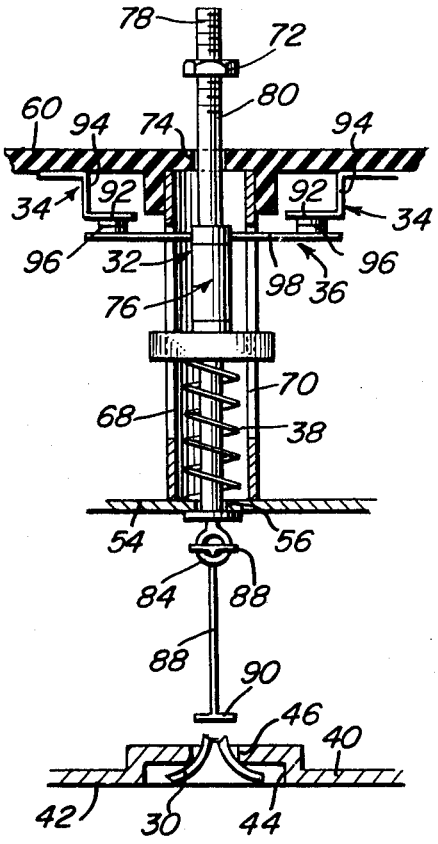
FIG. 4 is a fragmentary, sectional view, similar to FIG. 3, but showing the switch in the closed mode thereof.
Figure 5:
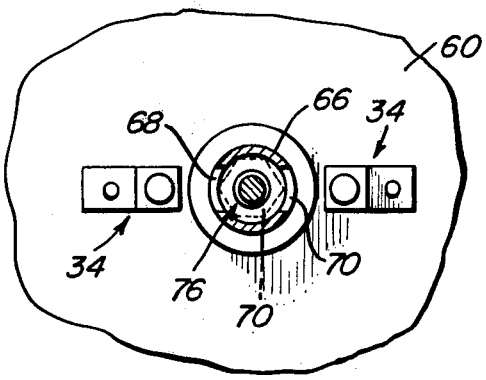
FIG. 5 is a fragmentary, sectional view taken generally along the line 5—5 of FIG. 3.
Figure 6:
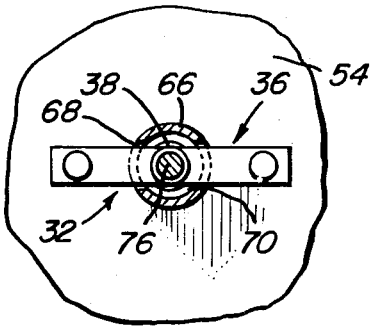
FIG. 6 is a fragmentary, sectional view taken generally along the line 6—6 of FIG. 3.

As will be appreciated from the above description and from the drawings, particularly FIGS. 3 and 4, if a small amount of water runs onto a support surface, such as a floor, on which base plate 40 is resting, such as will occur in a closet or utility room housing a hot water heater when the storage tank develops a small rust leak, the wafer or element 30, 106, will soften and quickly dissolve, or loosen, allowing T-head 90 of nylon fiber, and the like, filament 86 to be released and permit compression spring 38 to force the contactor blade 98 upward, thus putting points 996 into contact with points 92 and bridging the two low voltage terminals represented by lugs 12, 14. Switch 10 is re-usable simply by placing a new, hard or rigid element 30, 106 into recess 44, pulling or pushing push rod 76 down and threading the bottom T-head 90 of filament 86 through the small hole which is to be provided in the element 30, 106. Minor adjustments in the deflection of compression spring 38 are made in a simple manner by adjusting nut 72 on the thread 78 provided on end 80 of push rod 76.

The foregoing is considered as illustrative only of the principles of the invention. Further, since numerous modifications and changes will readily occur to those skilled in the art, it is not desired to limit the invention to the extact construction and operation shown and described, and accordingly all suitable modifications and equivalents may be resorted to, falling within the scope of the invention.

What is claimed as new is as follows:

1. A water responsive switch, comprising, in combination:

a. a support frame;

b. a water-soluble element arranged abutting the frame;

c. a member anchored on the water-soluble element and arranged biasing the element against the frame;

d. two electrical contact means, with one of the contact means, being affixed to the frame and the other of the contact means affixed to the member, the member being arranged extending toward the one of the contact means, both of the contact means including a pair of spaced points, the points of one of the contact means matched with the points of the other of the contact means for mating engagement by the points when the switch is in its closed mode, and lugs connected to the points of the one of the contact means for connecting the one of the contact means into an external electrical alarm circuit, a contactor blade affixed to the member with the points of the other of the contact means being mounted on the blade and electrically connected together for bridging the points of the one of the contact means when the switch is in its closed mode; and e. resilient means engaging the member and the frame for biasing the member toward the one of the contact means and bringing the other of the contact means into contact means into contact with the one of the contact means whenever the water-soluble element is loosened and releases the member, the member being arranged for movement relative to the frame.

2. A structure as defined in claim 1, wherein the support frame comprises a base plate including a support surface having a recess opening onto the support surface and provided with an aperture, the water-soluble element being disposed in the recess and the member being an elongated member arranged in the aperture, a housing, and a framework connected to the housing and to the base plate for supporting the housing in spaced relation above the base plate, the one of the contact means being disposed within the housing, the housing having a bottom wall arranged facing the base plate and provided with an opening aligned with the aperture provided in the base plate, and the elongated member being arranged in the opening and extending into the housing, with the other of the contact means being affixed to a portion of the elongated member disposed within the housing.

3. A structure as defined in claim 2, wherein the elongated member has an enlarged portion forming an abutment surface, the enlarged portion disposed within the housing, and the resilient means includes a compression spring disposed within the housing and arranged between, and abutting, the abutment surface of the enlarged portion of the elongated member and the bottom wall of the housing, the elongated member being arranged for deflecting the spring when the elongated member is anchored to the water-soluble element.

4. A water response switch, comprising, in combination:

a. a support frame;

b. a water-soluble element arranged abutting the frame;

c. a member anchored on the water-soluble element and arranged biasing the element against the frame;

d. two electrical contact means, with one of the contact means being affixed to the frame and the other of the contact means being affixed to the member, the member being arranged extending toward the one of the contacts; and e. resilient means engaging the member and the frame for biasing the member toward the one of the contact members and bringing the other of the contact means into contact with the one of the contact means whenever the water-soluble element is loosened and releases the member, the member being arranged for movement relative to the frame, the support frame comprising a base plate including a support surface having a recess opening onto the support surface and provided with an aperture, the water-soluble element being disposed in the recess and the member being an elongated member arranged in the aperture, a housing, and a framework connected to the housing and to the base plate for supporting the housing in spaced relation above the base plate, the one of the contact means being disposed within the housing, the housing having a bottom wall arranged facing the base plate and provided with an opening aligned with the aperture provided in the base plate, and the elongated member being arranged in the opening and extending into the housing, with the other of the contact means being affixed to a portion of the elongated member disposed within the housing, the elongated member having an enlarged portion forming an abutment surface, the enlarged portion disposed within the housing, and the resilient means includes a compression spring disposed within the housing and arranged between, and abutting, the abutment surface of the enlarged portion of the elongated member and the bottom wall of the housing, the elongated member being arranged for deflecting the spring when the elongated member is anchored to the water-soluble element, the housing further including a top wall spaced from the bottom wall of the housing, and a duct extending from the top wall to the bottom wall, the elongated member being disposed in the duct, a slot provided in the duct and arranged extending toward the top wall and bottom wall, and the other of the contact means and the enlarged portion of the elongated member being disposed in the slot for movement with the elongated member toward the top wall, the elongated member being provided with an adjustable stop element cooperating with the top wall for limiting movement of the elongated member toward the bottom wall of the housing.

5. A structure as defined in claim 4, wherein the water-soluble element is a disk provided with a central hole, and the elongated member includes a rigid push rod extending through the housing and on which the other of the contacts and the enlarged portion are affixed, and a length of flexible filament having T-heads at each spaced end thereof, with the push rod being provided with an eye at an end of the push rod disposed between the bottom wall of the housing and the base plate, one of the T-heads of the filament being attached to the eye of the push rod and the other of the T-heads being anchored to the disk by insertion of the other of the T-heads through the central hole provided in the disk.

6. A structure as defined in claim 5, wherein both the contacts include a pair of spaced points, the points of one of the contact means matched with the points of the other of the contact means for mating engagement by the points when the switch is in its closed mode, and lugs connected to the points of the one of the contact means for connecting the one of the contact means into an external electrical alarm circuit, with the points of the other of the contact means being electrically connected together for bridging the points of the one of the contact means when the switch is in its closed mode.

7. A structure as defined in claim 1, wherein the water-soluble element is a disk, and the member is an elongated member including a rigid push rod on which the other of the contacts is affixed, and a length of flexible filament having T-heads at each spaced end, with the push rod being provided with an eye at an end of the push rod closest to the water-soluble element, one of the T-heads being attached to the eye provided on the push rod, and the other of the T-heads anchored to the water-soluble element.

* * * * *